US009630174B2

(12) United States Patent
Sarna et al.

(10) Patent No.: US 9,630,174 B2
(45) Date of Patent: Apr. 25, 2017

(54) MECHANICAL PIPETTE WITH ADJUSTABLE VOLUME VALUE OF ASPIRATED LIQUID

(75) Inventors: Wojciech Sarna, Warszawa (PL); Romuald Andrzej Rylski, Warszawa (PL); Tomasz Strzelczyk, Warszawa (PL); Jacek Grochowski, Warszawa (PL); Jan Adam Bala, Pultusk (PL)

(73) Assignee: Corning Incorporated, Corning, NY (US)

( * ) Notice: Subject to any disclaimer, the term of this patent is extended or adjusted under 35 U.S.C. 154(b) by 575 days.

(21) Appl. No.: 13/390,767

(22) PCT Filed: Aug. 26, 2010

(86) PCT No.: PCT/PL2010/000078
§ 371 (c)(1),
(2), (4) Date: Feb. 16, 2012

(87) PCT Pub. No.: WO2011/025399
PCT Pub. Date: Mar. 3, 2011

(65) Prior Publication Data

US 2012/0148459 A1 Jun. 14, 2012

(30) Foreign Application Priority Data

Aug. 28, 2009 (PL) ..... 388912

(51) Int. Cl.
*B01L 3/02* (2006.01)

(52) U.S. Cl.
CPC ..... *B01L 3/0224* (2013.01); *B01L 3/0279* (2013.01); *B01L 2200/08* (2013.01); *B01L 2200/148* (2013.01); *B01L 2300/026* (2013.01)

(58) Field of Classification Search
CPC ..... B01L 3/021; B01L 3/0217; B01L 3/0224
(Continued)

(56) References Cited

U.S. PATENT DOCUMENTS 4,283,950 A 8/1981 Tervamaki
5,531,131 A 7/1996 Sabloewski
(Continued)

FOREIGN PATENT DOCUMENTS

DE 20321525 2/2008
EP 0566939 A1 10/1993
(Continued)

OTHER PUBLICATIONS

International Search Report for International Application No. PCT/PL2010/000078, Dated Jan. 4, 2011.
(Continued)

*Primary Examiner* — Jan Ludlow
(74) *Attorney, Agent, or Firm* — Susan S. Wilks; John P. Ciccarelli

(57) ABSTRACT

Mechanical pipette with adjustable volume value of aspirated liquid is built of a handle (1) and a nozzle (3) and coupled with them: an ejection mechanism of a pipette exchangeable tip (8), a drawing up and discharging mechanism with a plunger (33) mounted in said pipette nozzle (3), a plunger working stroke adjustment mechanism, a manually actuated lock mechanism of a drive assembly of an adjustment screw of the plunger working stroke, a mechanical counter, a drive mechanism of a mechanical counter and a calibration mechanism for correction of the pipette accuracy deviation. The calibration mechanism comprises, mounted in the mechanical counter, releasable coupling means for complete disengagement of a revolvers assembly from the mechanical counter drive mechanism in CALIBRATION MODE, further, engaged with them, changeover means for changing over the pipette into CALIBRATION MODE and resetting means of the indication of the liquid volume value on the counter in CALIBRATION MODE.

13 Claims, 5 Drawing Sheets

(58) Field of Classification Search
USPC ..... 422/516–518; 73/864.18
See application file for complete search history.

(56) References Cited

U.S. PATENT DOCUMENTS

| | | | | |
|---|---|---|---|---|
| 7,204,163 | B2 * | 4/2007 | Uldry et al. | 73/864.18 |
| 2003/0147781 | A1 | 8/2003 | Viot | |
| 2008/0223108 | A1 | 9/2008 | Kobayashi et al. | |

FOREIGN PATENT DOCUMENTS

| | | | |
|---|---|---|---|
| WO | 2005052781 | A2 | 6/2005 |
| WO | 2009067030 | A9 | 5/2009 |

OTHER PUBLICATIONS

European Patent Office, Communication Pursuant to Rule 69 EPC—Reminder Concerning Payment of Designation and Examination Fee and Invitation Pursuant to Rule 70a(1) EPC re: EP Application No. 15179305.6, mailing date Jan. 11, 2016, 2 Pages.
European Patent Office, European Search Opinion re: EP Application No. 15179305.6, mailing date Jan. 11, 2016, 7 Pages.
European Patent Office, European Search Report re: EP Application No. 15179305.6, mailing date Jan. 11, 2016, 3 Pages.
Japanese Patent Office, Translation of First Office Action re: JP Patent Application No. 2012-526683, filed Aug. 26, 2010. Date of Mailing Nov. 13, 2014, 4 Pages.
Japanese Patent Office, Translation of Second Office Action re: JP Patent Application No. 2012-526683, filed Aug. 26, 2010. Date of Mailing Jul. 31, 2015. 3 Pages.
Japanese Patent Office, Translation of Third Office Action re: JP Patent Application No. 2012-526683, filed Aug. 26, 2010. Date of Mailing Feb. 15, 2016, 2 Pages.

* cited by examiner

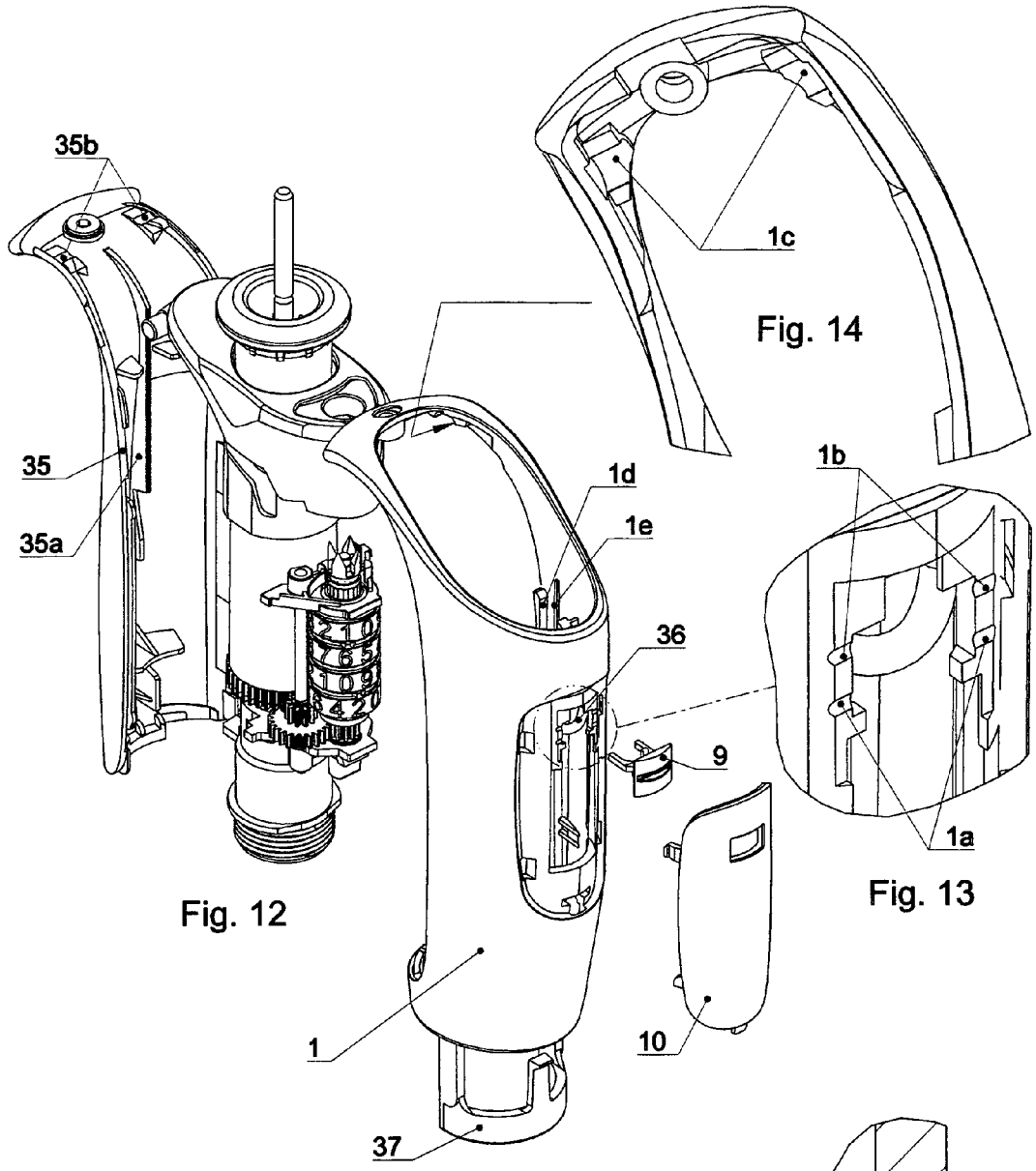
Fig. 12
Fig. 13
Fig. 14
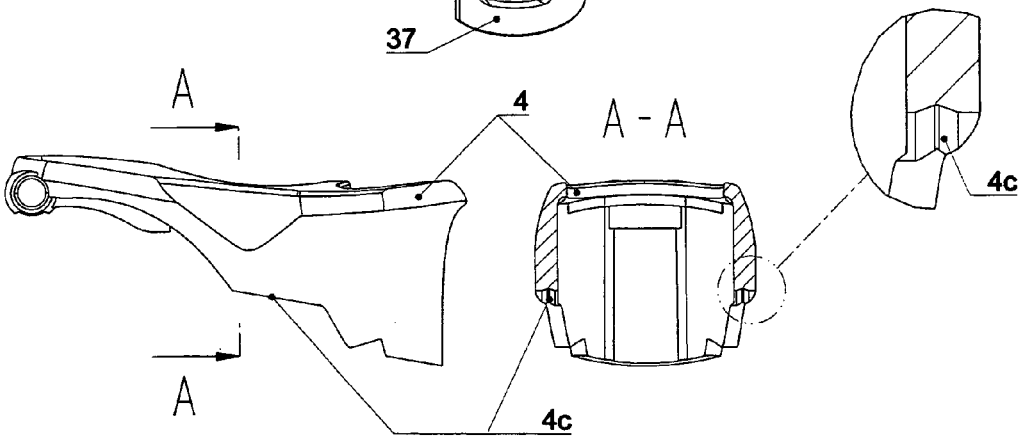
Fig. 15

MECHANICAL PIPETTE WITH ADJUSTABLE VOLUME VALUE OF ASPIRATED LIQUID

TECHNICAL FIELD

The invention relates to a mechanical pipette with an adjustable volume value of an aspirated liquid, which is designed for transferring and dispensing the liquid.

BACKGROUND ART

There are known electronic and mechanical pipettes with the adjustable volume value of the aspirated liquid, which are built in its upper part of a handle and in its lower part of a nozzle with a conical end for an exchangeable tip as well as of coupled with them and cooperating with each other mechanisms performing different functions in the pipette, namely a pipette exchangeable tip ejection mechanism, a drawing up and discharging mechanism, a plunger working stroke adjustment mechanism, a lock mechanism of the plunger working stroke adjustment mechanism, a drive mechanism of a mechanical counter indicating a liquid volume value that is drawn-up by the pipette, and a calibration mechanism.

The pipette exchangeable tip ejection mechanism comprises an ejector push button seated in the upper part of a pipette handle and an ejector seated at least by its lower end onto a pipette nozzle and, between them, intermediate means for transferring a force from the push button onto the ejector. This mechanism enables an exchange of the pipette tip when it is necessary when the pipette tip is worn or damaged or in the case when the need for the change of the working liquid volume values exists.

The drawing up and discharging mechanism comprises a pipetting button connected via a pipetting rod with a plunger that is placed in the pipette nozzle and is slidable therein in PIPETTING MODE of the pipette from and to its upper position. The plunger is driven towards the exchangeable tip by the force which is manually applied by an user to the pipetting push button. In the opposite direction, the plunger is driven in PIPETTING MODE by the pipetting spring force until it rests on an end stop mounted in the plunger working stroke adjustment mechanism.

In ADJUSTMENT MODE, a position of an upper stop of a plunger working stroke is being changed by means of a drive assembly of an adjustment screw of the plunger working stroke adjustment mechanism. The drive assembly of the plunger working stroke adjustment mechanism has a drive member which is accessible for the user from outside. The plunger working stroke adjustment mechanism controls a length of a plunger movement that is performed during liquid pipetting in PIPETTING MODE.

For ensuring an easy adjustment of the desired drawn-up liquid volume value, in the course of resetting adjustment elements of the plunger working stroke adjustment mechanism in ADJUSTMENT MODE, the torque, which is necessary for the change of the setting, should be as small as possible. Whereas, after the adjustment of the desired volume value during operation with the pipette in PIPETTING MODE, this torque should be sufficiently large to rule out any risk of an incidental pipette resetting to another volume value. This requires the application in the pipette an additional mechanism for changing a braking torque exerted on the plunger working stroke adjustment mechanism or an additional mechanism for disengagement the external adjustment elements of the plunger working stroke adjustment mechanism from the elements changing the position of the stop mounted in the plunger working stroke adjustment mechanism, which position determines the length of the plunger working stroke.

Therefore, for prevention the desired volume value of the drawn-up liquid, which is previously set in ADJUSTMENT MODE, from the accidental resetting during operation with the pipette in PIPETTING MODE, the pipettes are provided with a manually actuated lock mechanism for locking the adjustment mechanism of the plunger working stroke.

In the known pipettes, the lock mechanism of the plunger working stroke adjustment mechanism, which constitutes a releasable friction brake, is more often applied. This lock mechanism provides, after its actuation, the large braking torque exerted on the plunger working stroke adjustment mechanism and preventing in PIPETTING MODE from the unintentional resetting the desired volume value of the liquid previously aspirated by the pipette in ADJUSTMENT MODE. The lock mechanism simultaneously provides, after its release, the small braking torque which is exerted on the plunger working stroke adjustment mechanism and is necessary for adjustment of the desired volume value of the drawn-up liquid.

The plunger working stroke adjustment mechanism is via the drive mechanism of the mechanical counter engaged with the counter for indication the liquid volume value which is drawn-up by the pipette in PIPETTING MODE to the exchangeable tip and which is earlier pre-set by the user in ADJUSTMENT MODE by adjustment of the plunger working stroke. Thus, the length of the plunger movement in the nozzle, that is its working stroke, during pipetting in PIPETTING MODE, is altered by the user due to resetting structure elements of the plunger working stroke adjustment mechanism in ADJUSTMENT MODE. This simultaneously results in the change of the indications of the counter which indicates the pre-set desired liquid volume.

However, in many cases, the actual liquid volume value being drawn-up by the pipette differs from the one which is indicated by the counter. This difference between the actual drawn-up liquid volume value and the liquid volume value indicated by the counter is called as a pipette accuracy deviation. There are many factors affecting these inaccuracies, including, among others, a shape and a wear of the exchangeable tip, a dead volume of the air between the liquid in the exchangeable tip and the plunger, the mutual configuration of the component parts of the engaging mechanism which engages the adjustment mechanism with the counter as well as characteristics of the drawn-up liquid and operational conditions of the pipette. For compensation of the pipette accuracy deviation a calibration of the pipette is being carried out in CALIBRATION MODE.

For calibration, the pipettes are provided with the calibration mechanism which enables the correction of the pipette accuracy deviation in the pipette CALIBRATION MODE.

In the known electronic pipettes, especially with the indication on the counter display of the liquid volume values being drawn-up by the pipette, the pipette calibration is realized by the change of the counter indications into the actual liquid volume values drawn-up by the pipette at the given setting of the plunger working stroke, wherein these actual liquid volume values are determined on the basis of series of the liquid drawn-ups done and their weight measures done and, further, on the basis of the calculated pipette accuracy deviations that is differences between the desired liquid volume values and the actual values drawn-up by the pipette.

While, in the known mechanical pipettes, due to realization difficulties, the correction of the pipette accuracy deviation is possible only when the plunger working stroke adjustment mechanism is disengaged from the mechanical counter. Then, the plunger working stroke setting is being reset without the change of the mechanical counter indications or the mechanical counter indication is being reset without the change of the plunger working stroke setting. For correction of the pipette accuracy deviation, an additional knob or a calibration wrench is often used, resetting of which enables to match the liquid volume values drawn-up by the pipette to the counter indications.

From German patent specification No. DE 43 35 863 C1, there is known the pipette built of the adjustment mechanism for the plunger working stroke adjustment, the mechanical counter for indication of the dispensed liquid volume and the engaging mechanism, placed between the adjustment mechanism and the mechanical counter, for the pipette accuracy deviation correction which is the difference between the actual volume value of the dispensed liquid and the liquid volume value indicated on the counter. The pipette is provided with a change-over device for disengagement of the engaging mechanism and for the correction of the pipette accuracy deviation by resetting of the adjustment mechanism, and precisely, by the change of the position of the upper stop which is mounted in the plunger working stroke adjustment mechanism and onto which the plunger rests in PIPETTING MODE. The engaging mechanism has two, coupled with each other, the clutch face gear wheels, while the adjustment mechanism is coupled with the adjustment face gear wheel that is turned respectively to the plunger stroke, and the mechanical counter is coupled with the indication face gear wheel that is turned respectively to the indicated liquid volume. The first clutch face gear wheel is in gear with the adjustment face gear wheel, while, the second clutch face gear wheel is in gear with the indication face gear wheel. The clutch face gear wheels are arranged in the same axis, are rested on the spring and are movable by the change-over device along the axis in the direction opposite to the direction of the spring action and with the disengagement of at least one face clutch. In this pipette, the plunger working stroke adjustment mechanism is coupled with the mechanical counter via the releasable coupling which is disengaged before resetting the plunger working stroke without the change of the mechanical counter indications. In PIPETTING and ADJUSTMENT MODES, the engaging mechanism between the adjustment mechanism and the mechanical counter is continuously engaged, whereas in CALIBRATION MODE is disengaged and thereby the counter drive is also disengaged.

There is also known the mechanical pipette manufactured by PZ HTL S.A. company under the trademark DISCOVERY, in which the adjustment screw of the plunger working stroke adjustment mechanism is non-releasably connected with the mechanical counter. The adjustment screw while turning in the knob mounted in the pipette handle causes the change of the position of the upper stop being mounted in the adjustment mechanism and cooperating with the plunger of the drawing up and discharging mechanism. The position of the lower stop is constant. Due to such a structure, for calibration of this pipette, when the discrepancy between the counter indication and the actual volume value of the drawn-up liquid is observed, it is necessary to change the upper stop position without the change of the angle position of the adjustment screw. It is possible due to the calibration tap screw that is mounted in the adjustment knob. The change of the angle position of the calibration tap screw causes the change of the upper stop position at the stationary constant angle position of the adjustment screw and thereby the counter indication. Thus, it is possible to harmonise the actual drawn-up liquid volume value with the counter indication.

In the above presented mechanical pipettes, the correct calibration consists in the adaption of the plunger working stroke to the counter indications, which, however, requires the calculation of the angle through which the adjustment elements of the adjustment mechanism should be turned by means of the adjustment knob or the additional calibration tap screw so that the pipette draws up the liquid volume value that is indicated by the counter. These pipettes need to run series of additional evaluations of rotation angles of the respective adjustment elements. It is, thus, necessary during every calibration to use an operation manual in order to calculate through which angle the adjustment knob or the calibration tap screw should be turned for obtaining the desired change in the volume value of the liquid drawn-up by the pipette. This is inconvenient and burdensome for the user. And then, the correctness of the performed calibration should be checked. In case of the large discrepancy between the counter indication and the actual drawn-up liquid volume value, the one-step calibration of the pipette is likely to be impossible and several repetitions of the above listed activities will be necessary for the user to follow again for the correct calibration.

Moreover, there is known the mechanical pipette of BRAND company, which is present on markets under the trade mark Transferpette®S. The calibration in this pipette consists in the adaption of the counter indication to the actual volume value of the liquid drawn-up by the pipette at the given setting of the plunger working stroke and without the change of the setting. The actual volume values of the liquid drawn-up by the pipette at the given setting of the plunger working stroke are determined on the basis of series of the liquid drawn-ups and their weight measures and subsequently evaluated calculations of the pipette accuracy deviations, i.e. the differences between the desired liquid volume values and the actual volume values of the liquid drawn-up by the pipette. For the calibration, in this pipette, it is necessary to disengage, earlier, the plunger working stroke adjustment mechanism from the counter so that the change of the setting of the pipette plunger working stroke is, simultaneously, prevented and thereby the change of the volume value of the liquid drawn-up by the pipette is also prevented.

In this pipette, the change of the position of the upper stop mounted in the adjustment mechanism and cooperating with the plunger of the drawing up and discharging mechanism is realized by turning with the adjustment knob which is coupled, in ADJUSTMENT MODE, via the shape rod with the upper stop. The position of the lower stop is not changed. The adjustment knob is further fixed to the adjustment sleeve which is coupled fixedly via the toothed-wheel rim situated in its lower part with the mechanical counter. In the upper part, the adjustment sleeve is provided with the gear clutch for releasable coupling of the adjustment sleeve with the shape rod coupled with the adjustment knob. The adjustment knob is movable along the pipette axis between the upper extreme position and the lower extreme position. The adjustment knob in its lower extreme position is coupled with the upper stop of the adjustment mechanism and is connected with the adjustment sleeve i.e. is coupled with the counter. The pipette is in ADJUSTMENT MODE. The adjustment knob in its upper extreme position is disengaged from the upper stop but is still coupled with the adjustment sleeve i.e. is coupled with the counter. The pipette is in CALIBRATION MODE. Such a pipette construction enables the change of the mechanical counter indications without the change of the position of the upper stop limiting the axial movement of the plunger in PIPETTING MODE and thereby without the change of the volume value of the liquid drawn-up by the pipette. For changeover of the pipette from ADJUSTMENT MODE to CALIBRATION MODE, the adjustment knob should be moved upwards.

The above described manner of the pipette calibration, in which the pipette calibration is carried out by the counter indications change into the actual volume values of the liquid drawn-up by the pipette at the given plunger working stroke setting, is easier for the user than the one earlier described, in which the plunger working stroke setting is being adapted without the change mechanical counter indications, because it does not require any additional calculations of the angle, by which the calibration knob should be turned for obtaining the correct volume value of the liquid drawn-up. It is enough to change the indication into the actual volume value on the mechanical counter, which is determined at the given plunger working stroke setting on the basis on the number of the liquid drawn-ups and their weight measures.

However, in the described mechanical pipette of the BRAND company, due to the design of the applied coupling between the adjustment knob and the upper stop mounted in the adjustment mechanism, the disadvantageous unintentional resetting of the upper stop position takes place relatively easy, wherein the position of the upper stop determines the plunger working stroke. Thus, the unintentional change of the setting of the liquid volume value during disengagement activity and the subsequent engagement activity of the adjustment knob from and with the upper stop in the course of the changeover of the pipette from PIPETTING MODE or ADJUSTMENT MODE to CALIBRATION MODE and vice versa is quite often observed. If the complete disengagement does not take place, for example, because of the incidental too small upward movement of the adjustment knob or its momentary partial downward movement, or the momentary engagement takes place or in the course of the disengagement activity and then the reengagement activity, the unintentional change of the mutual configuration of the cooperating structure elements happens, which causes the disadvantageous uncontrolled change of the setting of the plunger working stroke i.e. the volume value of the liquid drawn-up, and thereby causes the incorrect calibration of the pipette.

DISCLOSURE OF INVENTION

The primary object of the present invention is to provide the mechanical pipette of the structure which enables easy, fast and improved calibration.

The second object of the present invention is to provide the mechanical pipette with the calibration mechanism for correction of the pipette accuracy deviation, this calibration mechanism designed to exclude an incidental change of the setting of the volume value of the liquid drawn-up by the pipette.

The next object of the present invention is to provide the mechanical counter of the structure which guarantees the reliability and correctness of the counter indications independently on disadvantageous changes of the dimensions and mutual arrangement of the counter structure elements i.e. component parts, which disadvantageous changes appear during periodic autoclaving process of the pipette and during operational use of the pipette.

The object of the present invention is to design the pipette provided with the lock mechanism of the plunger working stroke adjustment mechanism enabling fast and easy changeover of the pipette from ADJUSTMENT MODE to PIPETTING MODE when the adjustment of the desired drawn-up liquid volume is performed. Simultaneously, the pipette which guarantees dependability and reliability of the selected setting of the volume value both during the changeover of the operational mode onto the selected from CALIBRATING MODE, PIPETTING MODE or ADJUSTMENT MODE and during the primary operational mode that is PIPETTING MODE.

It is yet another object of the present invention to design the ejection mechanism of the improved structure with the advantageous non-linear characteristic of the ejection force transferred via the ejector into the exchangeable tip versus the longitudinal displacement of the ejector in the course of the ejector push button movement for rationalization of realization of TIP EJECTION MODE with simultaneous widening of portfolio of the exchangeable tips originating from different producers and possible to be used in the present pipette.

The pipette according to the present invention should provide the user with the high operational comfort due to its convenient one-hand operation.

The aimed objects have been achieved in the pipette according to the present invention which is presented below.

A mechanical pipette with an adjustable volume value of aspirated liquid, according to the present invention, is built of a handle and a nozzle and coupled with them

- a pipette exchangeable tip ejection mechanism comprising a push button of a ejector, which is seated in the upper part of a pipette handle, the ejector mounted on said pipette nozzle and, between them, intermediate means for transferring a force from said push button onto said ejector,
- a drawing up and discharging mechanism comprising a pipetting button connected via a pipetting rod with a plunger which is disposed in said pipette nozzle,
- a plunger working stroke adjustment mechanism provided with a drive assembly of an adjustment screw of a working stroke of said plunger,
- a manually actuated lock mechanism of said plunger working stroke adjustment mechanism,
- a mechanical counter for indication of a volume value of liquid drawn-up by the pipette depending on the adjusted plunger working stroke,
- a mechanical counter drive mechanism,
- a calibration mechanism for correction of a pipette accuracy deviation which constitutes the difference between the actual volume value of dispensed liquid and the liquid volume value indicated on said mechanical counter, wherein in the pipette said calibration mechanism comprises releasable coupling means which are mounted in said mechanical counter and serve the complete disengagement of a revolvers assembly from said mechanical counter drive mechanism in CALIBRATION MODE, and engaged with them changeover means for changing over the pipette into CALIBRATION MODE and resetting means for resetting the liquid volume value indication on said mechanical counter in CALIBRATION MODE.

Preferably, said releasable coupling means are slidably and rotatably arranged on a counter axis.

Preferably, said releasable coupling means comprise a clutch gear-wheel and a counter clutch.

Preferably, said coupling means comprise technical means for two-stage differentiation of a torque value which is necessary to induce a change of an angle position of said coupling means around said counter axis, wherein said technical means for two-stage differentiation of the torque value provide less torque value in ADJUSTMENT MODE and larger torque value in CALIBRATION MODE of the pipette.

Preferably, said technical means for two-stage differentiation of the torque value comprise a shape portion which has in its upper part smaller protrusions and has in its lower part larger protrusions for cooperating with elastic click of a counter cover, respectively, in ADJUSTMENT MODE and in CALIBRATION MODE of the pipette.

Preferably, said changeover means changing over the pipette into CALIBRATION MODE enable disengagement of said coupling means together with engaged therewith said revolvers assembly from said mechanical counter drive mechanism.

Preferably, said coupling means are engaged with said revolvers assembly via a revolver sleeve which is provided with longitudinal notches for receiving longitudinal protrusions of said coupling means and with a protrusion for engagement with a first revolver from said revolvers assembly of said mechanical counter.

Preferably, said changeover means for changing over the pipette into CALIBRATION MODE comprise a slider which is accessible from outside of the pipette and is engaged with said coupling means.

Preferably, for preventing against an incidental displacement in all pipette operational modes, said changeover means changing over the pipette into CALIBRATION MODE comprise additional elastic means, preferably constituting an elastic element in O-ring form.

Preferably, said resetting means for resetting the liquid volume value indication on said mechanical counter in CALIBRATION MODE comprise a shape end of said counter clutch for cooperation with a respectively shaped end of a calibration wrench, which is provided with a cross tongue.

Preferably, in said calibration mechanism, said counter axis has the respectively adapted length for precluding an incidental pipette changeover from CALIBRATION MODE to PIPETTING MODE during turning with said counter clutch in CALIBRATION MODE for the counter indication change.

A mechanical pipette with an adjustable volume value of aspirated liquid, according to the present invention, is built of a handle and a nozzle and coupled with them

- a pipette exchangeable tip ejection mechanism comprising a push button of a ejector, which is seated in the upper part of a pipette handle, the ejector mounted on said pipette nozzle and, between them, intermediate means for transferring a force from said push button onto said ejector,
- a drawing up and discharging mechanism comprising a pipetting button connected via a pipetting rod with a plunger which is disposed in said pipette nozzle,
- a plunger working stroke adjustment mechanism provided with a drive assembly of an adjustment screw of a working stroke of said plunger,
- a manually actuated lock mechanism of said plunger working stroke adjustment mechanism,
- a mechanical counter for indication of a volume value of liquid drawn-up by the pipette depending on the adjusted plunger working stroke,
- a mechanical counter drive mechanism,
- a calibration mechanism for correction of a pipette accuracy deviation which constitutes the difference between the actual volume value of dispensed liquid and the liquid volume value indicated on said mechanical counter, wherein in the pipette said ejection mechanism constitutes a hand operated second-class lever which rotation axis is perpendicular to a pipette axis and is located on the side of the pipette axis opposite to the point of application by the user to said push button an actuation force which actuates via intermediate means said ejector, wherein points of the transfer of said actuation force from said push button onto said intermediate means during angle movement of said push button displace along rectilinear contact surfaces of said push button.

Preferably, said intermediate means of said ejection mechanism comprise a frame which cooperates with a sleeve connected with said ejector, wherein said frame is provided with two parallel arms which are arranged symmetrically in relation to the pipette axis and are guided longitudinally in said handle for improvement of load symmetry of said exchangeable tip during its ejection from said nozzle in the course of the ejection movement in TIP EJECTION MODE of the pipette.

Preferably, said mechanical counter comprises additional elastic means for continuous mutual pressing mechanical counter structure elements along a counter axis for improvement an accuracy of mechanical counter indications and for prevention the pipette against incidental miscalibration during its operational use in ADJUSTMENT MODE and PIPETTING MODE.

Preferably, said additional elastic means of said mechanical counter comprise a counter spring which is disposed under a clutch gear-wheel.

Preferably, said drive mechanism comprises an adjustment sleeve with a toothed-wheel rim, a toothed gear with a double gear and a seated rotatably and slidably on said counter axis clutch gear-wheel with a shape clutch which cooperates with a releasable counter clutch mounted in said revolvers assembly.

Preferably, said lock mechanism is provided with a ratchet mechanism for exclusion of adjustment by the user of an adjustment knob of said adjustment mechanism in a transient position between ADJUSTMENT MODE and PIPETTING MODE of the pipette.

Preferably, said ratchet mechanism comprises a ratchets which are formed on said adjustment knob and which cooperate with grooves of an adjustment screw in ADJUSTMENT MODE of the pipette.

The advantage of the mechanical pipette according to the present invention is that it provides easy and fast calibration which is realized on the basis of the idea of adaptation of the indications of volume values on the mechanical counter to the actual volume values of the liquid drawn-up by the pipette. In the pipette the calibration mechanism has been applied of the structure which enables disengagement, in the CALIBRATION MODE, of the revolvers assembly of the mechanical counter from the toothed gear of the drive mechanism of the mechanical counter, while the adjustment knob of the plunger working stroke adjustment mechanism remains in the constant coupling with the plunger working stroke upper stop in LOCKED POSITION of the plunger working stroke adjustment mechanism. In CALIBRATION MODE or during the change of the operational mode of the present pipette from PIPETTING MODE into CALIBRATION MODE, the possibility of the incidental change of the position of the plunger working stroke upper stop was eliminated that is the possibility of the change of the setting of the liquid volume value was eliminated. The necessary disengagement of the cooperating mechanisms is provided by disengagement of the drive of the mechanical counter revolvers assembly from the adjustment knob. Due to such a solution, in the present pipette, the improved and rationalized calibration has been obtained.

The next advantage of the calibration mechanism that is applied in the present pipette is that the risk of the incidental pipette changeover from CALIBRATION MODE into PIPETTING MODE by pressing the counter clutch downwards under the pressure of the calibration wrench during turning the counter clutch for the change of the counter indication has been eliminated due to the respectively fitted length of the counter axis.

Another advantage of the calibration mechanism according to the present invention in comparison with the known pipettes is that in the pipette CALIBRATION MODE the calibration mechanism guarantees to the user the control of the change of the counter clutch angle position about the counter axis and thereby enabling the correct setting of the indication of the aspirated liquid volume value on the counter.

Moreover, the mechanical counter comprises the additional technical elastic means preventing the pipette against the incidental miscalibration during the pipette operational use in ADJUSTMENT and PIPETTING MODES.

The advantage of the present pipette is that the mechanical counter structure provides the compensation of the dimensions changes and mutual locations of the mechanical counter component parts, which changes appear in the pipette autoclaving process and during the pipette operational use. The structure described ensures reliability and correctness of the counter indications independently on the mentioned disadvantageous changes.

The advantage of the pipette is that the applied lock mechanism after adjustment in ADJUSTMENT MODE the desired volume value of the liquid being drawn-up in PIPETTING MODE, provides the brake moment for the adjustment mechanism suffieciently large for preventing the incidental change of the plunger working stroke setting in PIPETTING MODE, and thereby suffieciently large for preventing the incidental change of the volume value of the liquid drawn-up by the pipette. This increases reliability of liquid drawn-ups performed. The large force value which is necessary for the pipette changeover from PIPETTING MODE to ADJUSTMENT MODE prevents against the unintended changeover.

The important advantage of the lock mechanism is that due to a ratchet mechanism applied in it, the possibility of placing the adjustment knob by the user in the intermediate position between ADJUSTMENT MODE and PIPETTE MODE is eliminated.

The advantage of the ejection mechanism applied in the present pipette is that its structure enables reduction of the force indispensable to eject the tips and simultaneously provides the large ejector working stroke in the pipette.

The structure of the ejection mechanism provides in TIP EJECTION MODE the exchange of the air inside the pipette handle for maintenance the constant temperature value of the pipette internal component parts, what increases the accuracy of the drawn up and discharge liquid process by the pipette.

Due to the arrangement of the rotation axis of the hand second-class lever of the ejection mechanism in the present pipette on the side opposite to the pipette axis in relation to the side where the user by the finger applies the force to the ejector push button, in the ejection mechanism according to the present invention the large ejector working stroke was obtained what enables application of the exchangeable tips delivered by different producers.

The operation of the pipette with the ejection mechanism described is much more simpler because it does not require any additional adjustment activities of this mechanism for adaptation to cooperation with tips delivered by different suppliers.

The ejection mechanism provides advantageous non-linear characteristics of the ejection force transferred by the ejector onto the tip versus the longitudinal ejector movement during the ejector push button movement i.e. versus the rotation angle of the ejector push button. During the preliminary phase of the ejection movement, for overcoming the friction forces between cooperating conical surfaces, namely, the outer one of the pipette nozzle and the inner one of the tip upper end, the large ejection force imparted from the ejector onto the tip is needed. While, during the final phase of the ejection movement, for the ejection of the tip from the pipette nozzle the longer longitudinal displacement of an ejection edge of the ejector is necessary at the small ejection force.

In the structure of the ejection mechanism, the ejector is applied, which cooperates with the push button via the intermediate means comprising the frame provided with two arms symmetrically located in relation to the pipette axis and longitudinally guided in the handle. The structure results in even distribution of the force transferred from the ejector push button via the intermediate means and the ejector onto the tip during the ejection movement.

The structure of the ejection mechanism in the present pipette is much more simplified in comparison with the known solutions—the ejection mechanism comprises smaller number of the structure elements than the mechanisms known from the art.

Thus, the assembly time and the pipette manufacturing costs are reduced.

The operation of the pipette provided with the present ejection mechanism is more comfortable and efficient for the user.

The ejection mechanism described above is based on the idea of the second-class lever mechanism, the rotation axis of which is perpendicular to the pipette axis and is situated on the side of the pipette axis opposite to the point of application by the user to the ejection mechanism push button of the force actuating the ejection mechanism. The ejection mechanism can be applied in the mechanical pipettes of other structures than the presented one as well as in the electronic pipettes.

The mechanical pipette according to the present invention is conveniently operated by the user one hand.

The features of the pipette mechanisms presented in the attached to the present description independent claim 1 and depending claims 2 to 11 and 14 to 18 can be respectively selectively comprised in the embodiments of the pipette according to independent claim 12 and depending claim 13.

The features of the pipette mechanisms presented in the attached to the present description independent claim 12 and depending claims 13 and 14 to 18 can be respectively selectively comprised in the embodiments of the pipette according to independent claim 1 and depending claims 2 to 11.

BRIEF DESCRIPTION OF DRAWINGS

The invention preferred embodiment, given as a non-restrictive example, is presented with reference to the attached drawings, wherein.

BEST MODE OF CARRYING OUT THE INVENTION

The pipette with the adjustable volume of the aspirated liquid according to the invention in the preferred but non-limiting embodiment is presented in FIG. 1-15. Generally, this pipette is built of a handle 1 and a nozzle 3 and of coupled with them and cooperating with each other mechanisms which perform different functions of the mechanical pipette.

Figure 2:
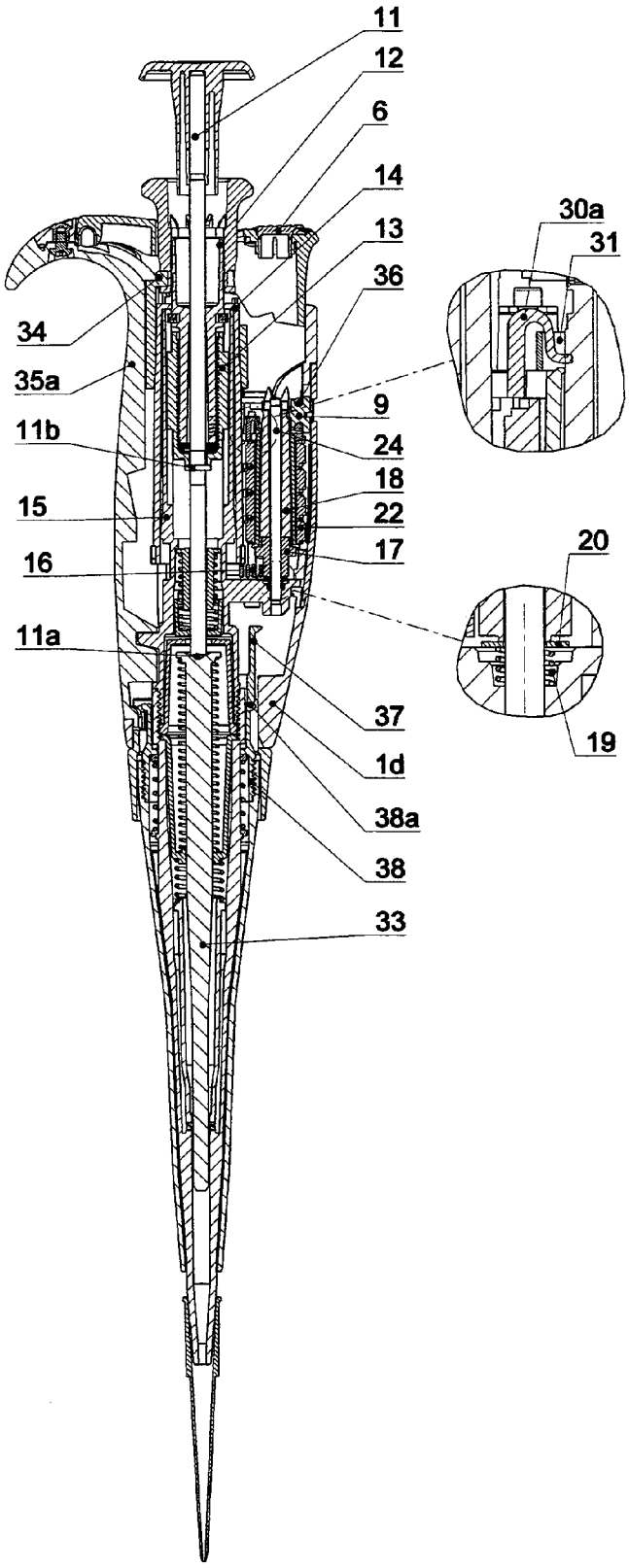
Figure 4:
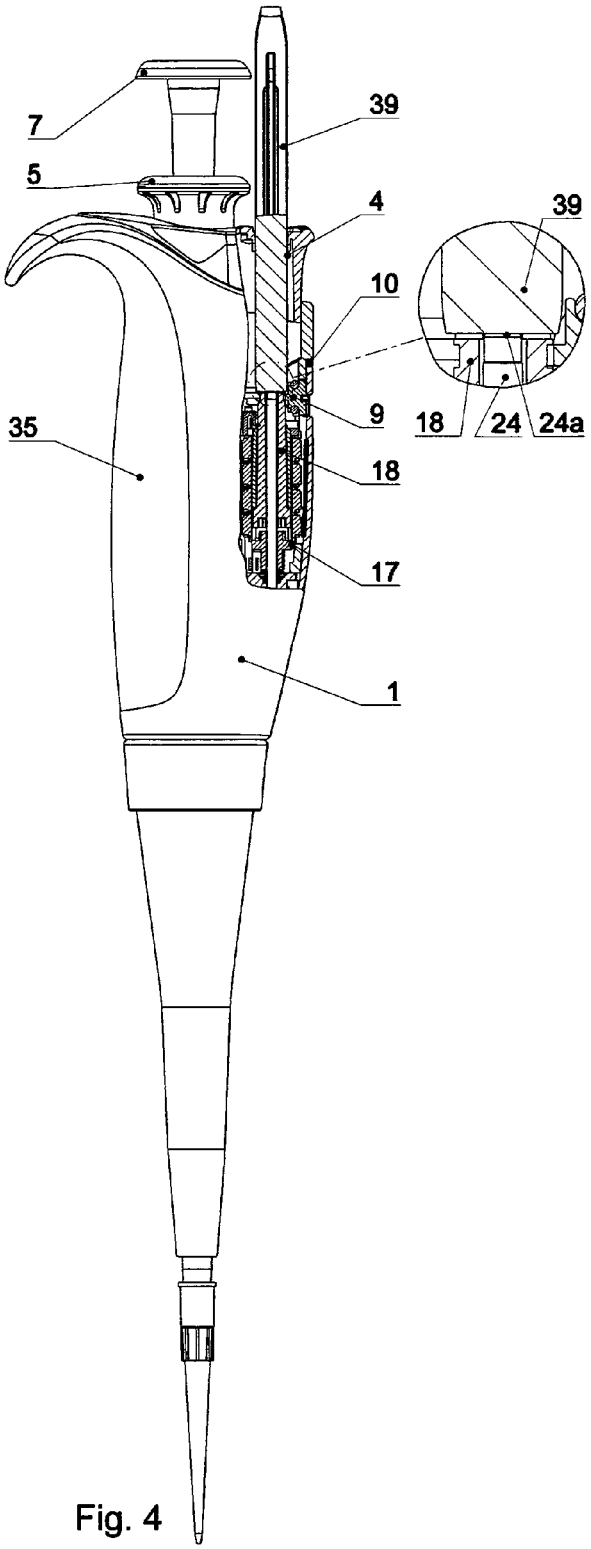

In the pipette according to the invention, an improved ejection mechanism of an exchangeable tip 8 is applied, which provides the present pipette with important operational and structure advantages. The ejection mechanism constitutes a second-class lever and comprises a push button 4 of an ejector 2, which is rotatably mounted in the upper part of the pipette handle 1 and the ejector 2 which surrounds the pipette nozzle assembly and, between them, intermediate means for transferring the force from the push button 4 to the ejector 2. The rotation axis of the push button 4 of the ejector 2 is perpendicular to the pipette axis and is situated on the side of the pipette axis opposite to the point of the application by the user to the push button 4 of the force actuating the ejection mechanism. The intermediate means of the ejection mechanism comprise a frame 37 which cooperates with a sleeve 38 connected with the ejector 2. The push button 4 presses onto two parallel arms 37*a* of the frame 37 which is movable along the mechanical pipette axis. The frame 37, in turn, presses onto the sleeve 38 which is connected by a screw connection with the ejector 2 movable along the mechanical pipette axis, as shown in FIGS. 2 and 4. The arms 37*a* of the frame 37 are symmetrically arranged in relation to the pipette axis and are longitudinally guided in the handle 1 for improving symmetry of guidance of the exchangeable tip 8 along the ejector 2 during the ejection movement in TIP EJECTION MODE.

Figure 1:
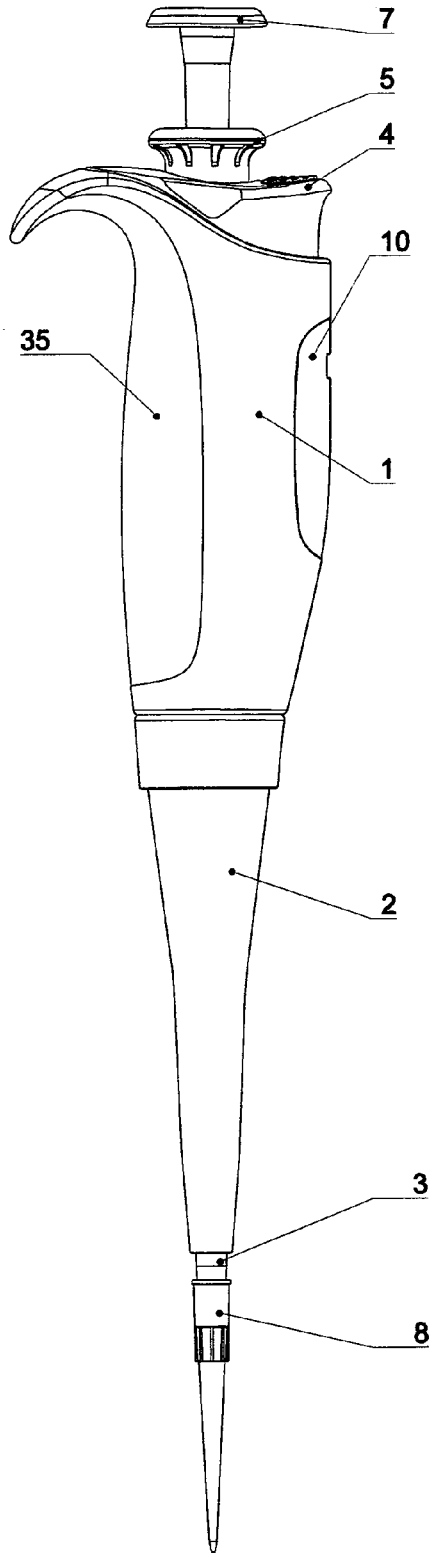
FIG. 1 presents the mechanical pipette with the adjustable drawn-up liquid volume value in the general view, in PIPETTING MODE with the plunger working stroke adjustment mechanism in LOCKED POSITION that is with the adjustment knob in its extreme lower position, FIG. 2—presents the pipette from FIG. 1 in the longitudinal section with the enlarged cut fragment showing fastening of the revolvers axis with the counter spring and with the enlarged cut fragment showing the counter ratchet mechanism, FIG. 3—presents the pipette in the longitudinal section in ADJUSTMENT MODE with the plunger working stroke adjustment mechanism in UNLOCKED POSITION that is with the adjustment knob in its extreme upper position, FIG. 4—presents the pipette in the general view in CALIBRATION MODE with the depicted partial longitudinal section through the mechanical counter with the calibration wrench resting against the counter axis face and with the enlarged cut fragment of this area, FIG. 5—presents in the exploded perspective view seen from the top the internal structure elements of the pipette handle, FIG. 6—presents in the exploded perspective view seen from the bottom the internal structure elements of the pipette handle, FIG. 7—presents in the perspective view the adjustment knob, FIG. 8—presents the counter clutch in the perspective views and in the longitudinal section, FIG. 9—presents the revolvers sleeve in the perspective view, FIG. 10—presents the slider in the perspective view, FIG. 11—presents the brake sleeve in the perspective view and in the longitudinal section, FIG. 12—presents the main assemblies of the mechanical pipette handle in the exploded perspective view, FIG. 13—presents the enlarged fragment of the handle, which cooperates with the slider, FIG. 14—presents the enlarged fragment of the handle, which cooperates with the ejector push button, seen from the bottom, and FIG. 15—presents the enlarged general view and the longitudinal section A-A of the ejector push button and its fragment showing the contact surface of the canopy notch which cooperates with the respectively canopy end of the ejector frame arm.

A drawing up and discharging mechanism comprises a pipetting button 7 connected via a pipetting rod 11 with a plunger 33 mounted inside the pipette nozzle 3. On the nozzle 3, for performing PIPETTING MODE, the exchangeable tips 8 are seated with interference, as shown in FIGS. 1 and 2.

Figure 3:
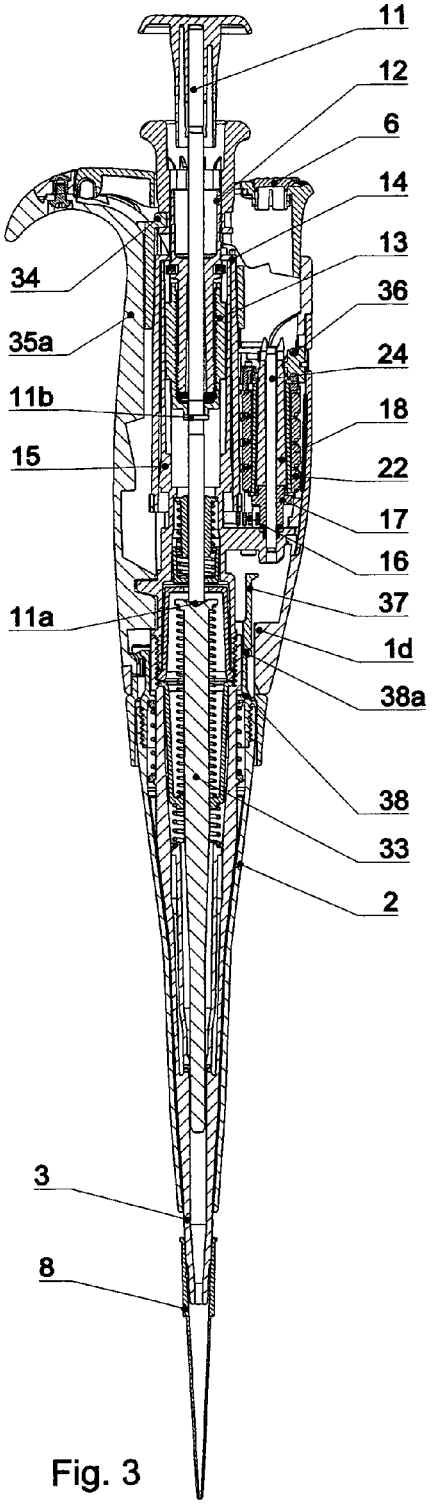

A plunger working stroke adjustment mechanism is provided with a adjustment knob 5 coupled via an adjustment screw 12 with an upper stop 13 of the working stroke of the plunger 33 that is placed in a nozzle assembly. The plunger working stroke adjustment mechanism has two positions, namely, LOCKED POSITION for realization of PIPETTING MODE as shown in FIGS. 1 and 2 and UNLOCKED POSITION for realization of ADJUSTMENT MODE as shown in FIGS. 3 and 4.

Figure 5:
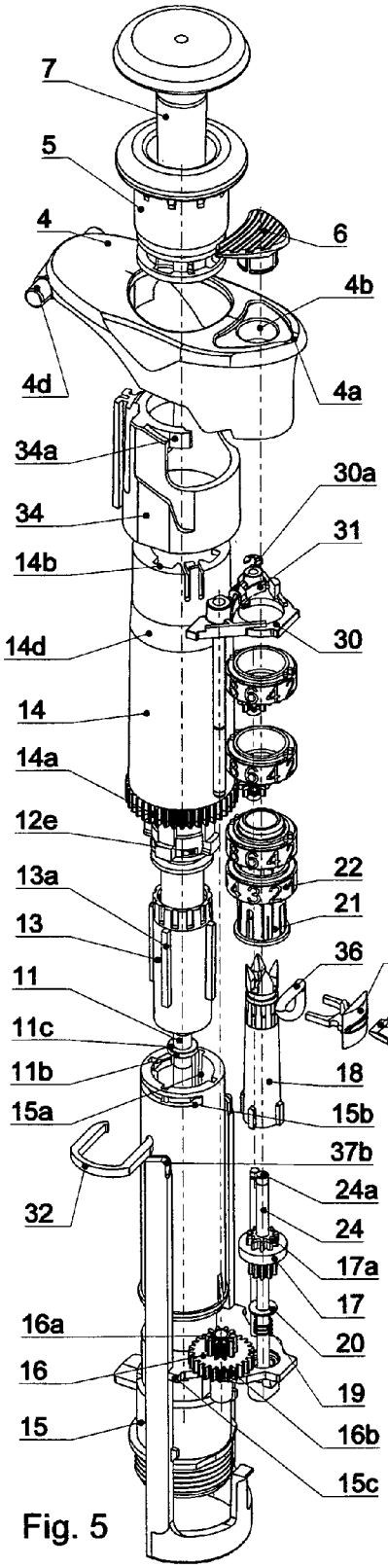
Figure 6:
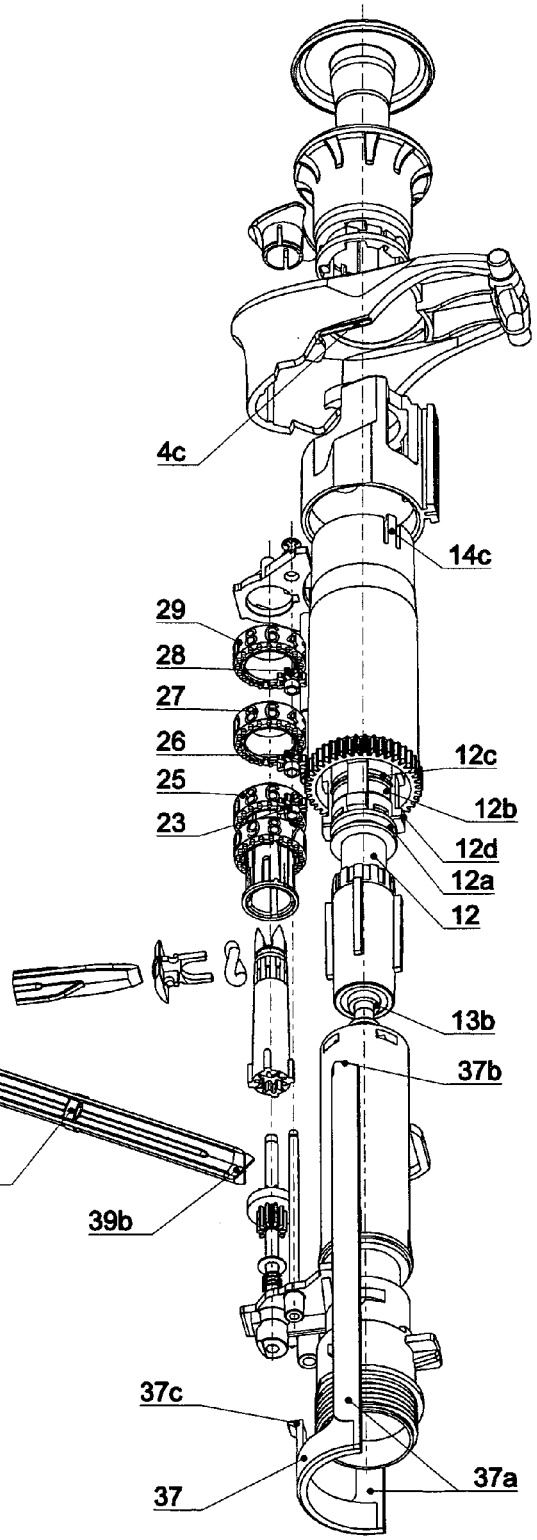
Figure 7:
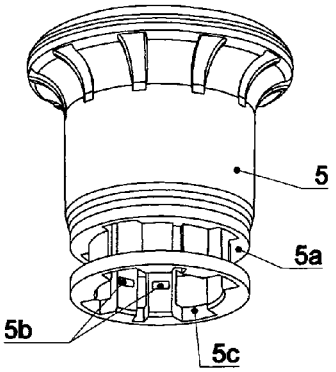

For the change of the position of the plunger working stroke adjustment mechanism, the pipette has a lock mechanism of the plunger working stroke adjustment mechanism, which is manually activated by displacement of the adjustment knob 5 along the pipette axis and between its extreme lower position in LOCKED POSITION of the plunger working stroke adjustment mechanism and its extreme upper position in UNLOCKED POSITION of the plunger working stroke adjustment mechanism. The lock mechanism comprises a brake assembly of the adjustment screw 12, which cooperates with the adjustment knob 5 and which comprises a brake sleeve 34 having a guiding arm 34*c* with a groove 34*d* for cooperation with rib 35*a* of a cover 35 of the handle 1 to precludes the rotation of the brake sleeve 34 and an adjustment sleeve 14 coupled with the adjustment screw 12, as shown in FIGS. 5 and 6. Such a rotational movement, which is eliminated in the present pipette, would cause the disadvantageous change of the setting of the drawn-up liquid volume value. The lock mechanism applied in the present pipette constitutes the releasable friction brake, which after its actuation provides the large braking moment exerted onto the plunger working stroke adjustment mechanism and prevents against an incidental changeover in PIPETTING MODE and in CALIBRATION MODE and, simultaneously, after its release enables the change of the setting of the plunger working stroke, which is necessary for the adjustment of the desired drawn-up liquid volume value.

The plunger working stroke adjustment mechanism is in all pipette operational modes continuously engaged and coupled via the toothed gear of the drive mechanism with the clutch gear-wheel, and a revolvers assembly of the mechanical counter, in CALIBRATION MODE of the pipette, is disengaged from a clutch gear-wheel 17 which drives the revolvers assembly in ADJUSTMENT MODE of the pipette.

Figure 8:
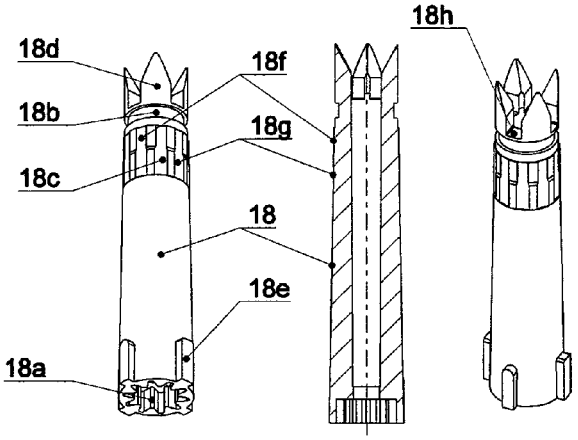
Figure 9:
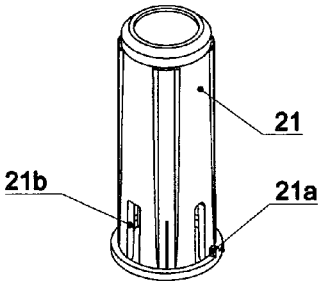

A drive mechanism of the mechanical counter for indication of the volume value of the liquid drawn-up by the pipette in dependency on the plunger working stroke pre-set in ADJUSTMENT MODE, which is applied in the present pipette, comprises an adjustment sleeve 14 with a toothed-wheel rim 14*a*, the toothed gear with a double gear 16 as well as the clutch gear-wheel 17. The clutch gear-wheel 17 is mounted rotatably and slidably on a counter axis 24 and has in its upper part a shape clutch 17*a* that cooperates with the respectively formed lower part of a releasable counter clutch 18, which, in turn, by means of its protrusions 18*e* cooperates with respective notches 21*b* of a revolver sleeve 21, as shown in FIGS. 5, 6 and 8.

A calibration mechanism which is applied in the present pipette for correction of the pipette accuracy deviation which constitutes the difference between the actual volume value of the dispensed liquid and the volume value of the liquid indicated on the counter, eliminates the above described disadvantageous phenomena present in the known pipettes in CALIBRATION MODE. This is due to the structure which enables disengagement of the drive of the counter revolvers assembly from the adjustment knob 5 without disengagement of the drive of the upper stop 13 from the adjustment knob 5 of the adjustment mechanism. For this purpose, in the mechanical counter the releasable coupling means are disposed. The releasable coupling means serve the complete disengagement, in CALIBRATION MODE, of the revolvers assembly from the drive mechanism of the mechanical counter and the plunger working stroke adjustment mechanism for the change of the indication of the drawn-up liquid volume value at the given setting of the plunger working stroke by means of resetting the angle location of the revolvers in the revolvers assembly. The releasable coupling means comprise the clutch gear-wheel 17 and the counter clutch 18 which is being disengaged from the clutch gear-wheel 17 and the toothed gear of the drive mechanism before the counter indication correction.

The nozzle assembly with the nozzle 3 is screwed down to the lower part of the handle 1, and on the conical lower part of the nozzle 3 the exchangeable tip 8 is mounted.

All mechanisms of the pipette according to the present invention will be described in detail together with the presentation of the subsequent operational modes of the pipette.

The mechanical pipette with the adjustable volume of the drawn-up liquid according to the invention has the following operational modes, namely ADJUSTMENT MODE, PIPETTING MODE, CALIBRATION MODE and TIP EJECTION MODE.

Adjustment Mode

In the mechanical pipette according to the present invention, the drawn-up liquid volume value is indicated on the three- or four-position mechanical counter which is driven by the means of the toothed gear of the mechanical counter drive mechanism. The toothed gear via the adjustment sleeve 14 with the toothed-wheel rim 14*a* receives rotational movement from the adjustment screw 12 coupled with the adjustment knob 5 of the plunger working stroke adjustment mechanism. The toothed gear via the double gear 16 and the clutch gear-wheel 17 with the shape clutch 17*a* transfers this rotational movement and, simultaneously, multiplies this rotational movement onto three or four revolvers of the counter. The revolver of the revolvers assembly is also named in the technical field as the counter wheel or the number wheel of the mechanical counter. These revolvers of the counter are driven by means of pinions 23, 26, and possibly 28. In the drawings, there is presented the embodiment of the pipette according to the invention with four-position counter which four revolvers 22, 25, 27, 29 are driven by the three pinions 23, 26, 28.

In order to change the setting of the volume value of the liquid drawn-up by the pipette, the pipette has to be changed over into ADJUSTMENT MODE i.e. the working stroke adjustment mechanism into UNLOCKED POSITION, and thus the lock mechanism of the plunger working stroke adjustment mechanism needs to be released by release of the friction brake.

Figure 11:
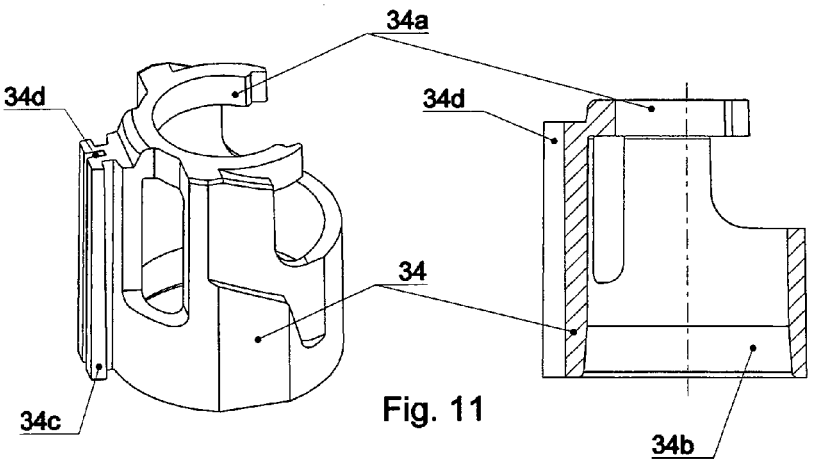

The adjustment of the drawn-up liquid volume value is realized in the pipette ADJUSTMENT MODE, shown in FIG. 3 and FIG. 4. To changeover the pipette from PIPETTING MODE, shown in FIG. 1 and FIG. 2, to ADJUSTMENT MODE the adjustment knob 5, shown in enlargement in FIG. 7, has to be moved from its lower extreme position into its upper extreme position—until the ratchets 5*b* of the adjustment knob 5 jump into grooves 12*c* of the adjustment screw 12, see FIGS. 5 and 6. This displacement of the adjustment knob 5 causes the upward movement of the brake sleeve 34 of the brake assembly of the adjustment screw 12 of the lock mechanism of the plunger working stroke adjustment mechanism. The brake sleeve 34, shown as enlarged in FIG. 11, is engaged with the adjustment knob 5 by means of a yoke 34*a* which is located in a circumferential groove 5*a* of the adjustment knob 5, what enables free rotating the adjustment knob 5. The brake sleeve 34 is protected against the rotation in relation to the pipette axis by means of a guiding arm 34*c* which groove 34*d* cooperates with a rib 35*a* of a cover 35 od the handle 1, see FIG. 12.

The displacement of the adjustment knob 5 to its upper extreme position causes that two braking cones: a cone 34*b* of the brake sleeve 34, shown in FIG. 11, and a cone 14*d* of the adjustment sleeve 14, shown in FIG. 5, move away from each other, which results in the decay of friction forces between these two conic surfaces. This enables to change the setting of the volume value of the liquid drawn-up by the pipette. The plunger working stroke adjustment mechanism is in UNLOCKED POSITION in which the pipette ADJUSTMENT MODE is being performed.

When the adjustment knob 5 is moved into its lower extreme position, the friction forces between the cone 34*b* of the brake sleeve 34 and the cone 14*d* of the adjustment sleeve 14 are induced and the possibility of the rotation of the adjustment sleeve 14 in relation to the pipette axis is locked. The plunger working stroke adjustment mechanism is in LOCKED POSITION in which the pipette PIPETTING MODE is being performed.

The blockade of the setting of the desired drawn-up liquid volume value is particularly required feature of the mechanical pipette because it prevents against the incidental change of the setting and thereby guarantees the required reliability of the liquid drawn-ups taken. The high value of the force necessary to be applied by the user to the adjustment knob 5 and needed to the pipette changeover from PIPETTING MODE into ADJUSTMENT MODE prevents against an unintended changeover.

Additionally, due to application in the present pipette the ratchet mechanism, the possibility of the location by the user of the adjustment knob 5 in the position between two operational modes of the pipette, namely between ADJUST- MENT MODE and PIPETTING MODE, was eliminated. The ratchet mechanism applied in the lock mechanism of the present pipette comprises the ratchets 5B formed on the adjustment knob 5, which ratchets 5*b* in the pipette ADJUSTMENT MODE cooperate with the grooves 12*c* of the adjustment screw 12.

ADJUSTMENT MODE in the mechanical pipette according to the present invention is performed in UNLOCKED POSITION of the plunger working stroke adjustment mechanism and consists in that the desired volume value of the liquid drawn-up by the pipette is manually set by turning the adjustment knob 5 which is in its upper extreme position. The adjustment knob 5 is coupled with the adjustment screw 12, the rotational movement of which induces linear movement of the upper stop 13. The upper stop 13 determines the working stroke of the plunger 33 and constitutes a nut cooperating with the adjustment screw 12, as shown in FIGS. 5 and 6. In ADJUSTMENT MODE, by means of the adjustment knob 5 and the adjustment screw 12 of the plunger working stroke adjustment mechanism, the position of the upper stop 13 is being changed.

The upper stop 13 is protected against the rotation by means of its longitudinal ribs 13*a* cooperating with guiding grooves 15*a* on the inner surface of a bearing sleeve 15, as shown in FIGS. 4 and 5. The screw 12 is axially fixed in the bearing sleeve 15 by means of a lock 32. The lock 32 is seated in a circumferential groove 12*a* of the adjustment screw 12 and in rectangular openings 15*b* of the bearing sleeve 15. The upper stop 13 is a limiter of the upper position of the pipetting rod 11 which abuts with the upper surface 11*c* of the circumferential tongue 11*b* on the lower surface 13*b* of the upper stop 13. The spherical lower end 11*a* of the pipetting rod 11 contacts with and affects the pipette plunger 33, which executes the axial movement for aspiration and discharge of the desired volume value of the liquid drawn-up by the pipette, as shown in FIG. 4. Rotating with the adjustment knob 5, which is engaged with the adjustment screw 12 by means of notches 5*c* cooperating with ribs 12*d* of the adjustment screw 12, causes the rotation of the adjustment sleeve 14 of the drive mechanism. The adjustment sleeve 14 is mounted on the adjustment screw 12 by means of notches 14*b* cooperating with the ribs 12*d* of the adjustment screw 12, see FIGS. 5 and 6. The adjustment sleeve 14 has in its lower part the toothed-wheel rim 14*a* coupled with the double gear 16, which, in turn, drives the clutch gear-wheel 17. The clutch gear-wheel 17 has in its upper part a shape clutch 17*a* which, in ADJUSTMENT MODE, cooperates with the respectively shaped lower portion 18*a* of the counter clutch 18, shown in enlargement in FIG. 8. The counter clutch 18 is a structure element of the releasable coupling means of the calibration mechanism, which serve to complete disengagement in CALIBRATION MODE of the revolvers assembly from the drive mechanism of the mechanical counter. The counter clutch 18 is continuously engaged by means of the longitudinal protrusions 18*e* with the notches 21*b* of the revolver sleeve 21. The revolver sleeve 21, which is shown in enlargement in FIG. 9, causes by means of the protrusion 21*a* driving of the first revolver from the revolvers assembly, namely the counter revolver 22. The counter revolver 22, in turn, drives by means of the pinion 23 the counter revolver 25. The counter revolver 25, in turn, drives by means of the next pinions 26, 28 the next revolvers 27, 29 of the revolver assembly, which are mounted ratatably on the revolver sleeve 21.

The plunger working stroke adjustment mechanism is in all pipette operational modes continuously actuated and continuously engaged via the toothed gear of the drive mechanism with the clutch gear-wheel 17. The mechanical counter assembly comprises the clutch gear-wheel 17, the counter clutch 18, the revolvers sleeve 21, the revolvers 22, 25, 27, 29 and the pinions 23, 26, 28. The mechanical counter assembly is continuously pressed to the counter cover 30 in results of application of a counter spring 19 which via a washer 20 exerts the axial force onto the lower surface of the clutch gear-wheel 17. Due to such a construction, all clearances between the structure elements of the mechanical counter assembly are continuously compensated. Further, also dimensional changes of the structure elements, which appear in results of the thermal expansion of materials during the process of autoclaving, are compensated. The application of the counter spring 19 guarantees the operational reliability of the counter assembly due to elimination of possible indication errors which arise in consequence of the positions change of the structure elements of the counter assembly in results of the clearances appearing in the course of the pipette operating and in the course of the autoclaving process.

For discretisation of the counter indications, in the mechanical counter assembly in the pipette according to the present invention, the ratchet mechanism is applied. The ratchet mechanism comprises an elastic click 30*a* of the counter cover 30, as shown in FIGS. 2 and 5, and the shape portion 18*c* which is respectively shaped and is formed on the counter clutch 18, as shown in FIG. 8. The elastic click 30*a* is pressed to the shape portion 18*c* of the counter clutch 18 due to operation of the spring 31 acting, as shown in FIG. 2. The structure of the shape portion 18*c* of the counter clutch 18 enables the torque value differentiation, which torque is necessary for the change of the angle position of the counter clutch 18 in relation to the counter axis 24 and in dependence on the current operational mode of the pipette. The technical means for two-stage differentiation of a torque value, with which the present pipette is provided, comprise the shape portion 18*c* which has in its upper part the smaller protrusions 18*f* for cooperation with the elastic click 30*a* of the counter cover 30 in ADJUSTMENT MODE and has in its lower part the larger protrusions 18*g* for cooperation with the elastic click 30*a* of the counter cover 30 in the pipette CALIBRATION MODE.

And thus, in ADJUSTMENT MODE, the counter clutch 18 is driven via the toothed gear which comprises the adjustment sleeve 14 which has in its lower part the toothed-wheel rim 14*a* coupled with the pinion 16*a* of the double gear 16. The gear 16*b* of the double gear 16, in turn, further drives the clutch gear-wheel 17, as shown in FIG. 5. The overall gear ratio of this toothed gear is equal of, for example, 10:1, and thus the complete single rotation of the adjustment knob 5 around the pipette axis causes ten, 10, complete rotations of the counter clutch 18 around the counter axis 24.

The effect of application between the adjustment knob 5 and the counter clutch 18 the toothed gear with gear ratio of 10:1, is the necessity to exert by the user onto the adjustment knob 5 the torque which is 10 times larger than the torque transferred by the counter clutch 18 and which is indispensable for the change of the angle position of the counter clutch 18 around the counter axis 24. For decrease the torque on the counter clutch 18 and in consequence on the adjustment knob 5, in the upper part of the shape portion 18*c*, the smaller protrusions 18*f* were formed on the counter clutch 18. The smaller protrusions 18*f* are different form the larger protrusions 18*g* in the lower part of the shape portion 18*c*. In such a way, the resistance moment caused by the deflection of the elastic click 30*a* of the counter cover 30 during rotation of the counter clutch 18 has been decreased. Thus, in pipette ADJUSTMENT MODE, the elastic click 30*a* of the counter cover 30 cooperates with the upper part of the shape portion 18*c* of the counter clutch 18, which has the smaller protrusions 18*f* which provide the less value of the torque necessary to induce the change of the angle position of the counter clutch 18. Due to such a structure, the change of the mechanical counter indication in result of the change of the setting of the volume value of the drawn-up liquid is easier in ADJUSTMENT MODE of the pipette.

Pipetting Mode

In PIPETTING MODE of the pipette, the plunger working stroke adjustment mechanism has to be in LOCKED POSITION and the lock mechanism has to be actuated i.e. the friction brake in the described preferred embodiment of the pipette is in the actuated position as shown in FIGS. 1 and 2.

After adjustment of the desired volume value of the drawn-up liquid, the pipette is being changed over from ADJUSTMENT MODE into PIPETTING MODE via the displacement of the adjustment knob 5 to its lower extreme position and the plunger working stroke adjustment mechanism is being entered into LOCKED POSITION. In this position, between the cone 34*b* of the brake sleeve 34 and the cone 14*d* of the adjustment sleeve 14 of the brake assembly of the adjustment screw 12 of the lock mechanism of the plunger working stroke adjustment mechanism, the friction forces are induced.

For the execution of PIPETTING MODE, the pipette has the drawing up and discharging mechanism which is mounted inside the handle 1 and the nozzle 3. The drawing up and discharging mechanism comprises the pipetting button 7 on the pipette upper end above the handle 1, which is connected via the pipetting rod 11 with the plunger 33 disposed in the pipette nozzle 3.

The user, by the pipetting button 7, pushes the pipetting rod 11 downwards and then this movement is via a spherical lower end 11*a* of the pipetting rod 11 transferred onto the plunger 33 inside the nozzle 3 and against the force of the pipetting spring. In the pipette PIPETTING MODE, during downward movement the plunger 33 push out an air from the nozzle 3 outside the end 8. When the pipetting rod 11 is pushed home, the plunger 33 stops in its lower position. When the tip 8 is dipped in the liquid and the pipetting button 7 is released, the plunger 33 under action of the pipetting spring returns to its upper position and simultaneously aspirates the liquid to the tip 8. For tip evacuation, the pipetting button 7 has to be again pressed down so that the plunger 33 moves to its lower position.

In the pipette PIPETTING MODE, there is also being controlled how much the actual volume value of the liquid drawn-up by the pipette differs from that indicated by the counter. This difference between the actual volume value of the liquid drawn-up by the pipette and the liquid volume value indicated by the counter is called the pipette accuracy deviation. For this purpose, the series of the liquid drawn-ups is carried out, and then their weight measures and on this basis the actual pipette drawn-up liquid volume value is being determined at the given adjustment of the plunger working stroke i.e. at the given counter indication. In the case when the difference between the desired pipette drawn-up liquid volume value and the actual volume value is ascertained, these different volume values are being brought into conformity with each other by correction of the pipette accuracy deviation i.e. by the change of the mechanical counter indication into the actual volume value of the liquid drawn-up by the pipette. The change of the mechanical counter indication is carried out in CALIBRATION MODE.

Calibration Mode

In the case when the discrepancy between the aspirated liquid volume value and the volume value indicated on the counter is observed, the pipette should be calibrated. The calibration in the presented pipette is based on resetting of the mechanical counter indication to the actual volume value of the drawn-up liquid.

During CALIBRATION MODE, in the calibration mechanism, the drive of the mechanical counter revolvers assembly is completely disengaged from the toothed gear of the mechanical counter drive mechanism, wherein the adjustment knob 5 of the plunger working stroke adjustment mechanism remains in the continuous coupling with the upper stop 13 of the plunger working stroke in LOCKED POSITION of the plunger working stroke adjustment mechanism.

The disengagement is in the present pipette possible due to application in the calibration mechanism and exactly in the mechanical counter the releasable coupling means. The releasable coupling means are engaged with changeover means changing over the pipette into CALIBRATION MODE and are also engaged with resetting means for resetting the indication of the liquid volume value on the counter in CALIBRATION MODE.

The releasable coupling means are slidably and rotatably mounted on the counter axis 24. The releasable coupling means comprise the clutch gear-wheel 17 and the counter clutch 18 and are coupled with the revolvers assembly via the revolver sleeve 21 which is provided with the longitudinal notches 21*b* for receiving the longitudinal protrusions 18*e* of the coupling means and with the notch 21*b* for engagement with the first revolver 22 of the counter revolvers assembly.

The changeover means for changing over the pipette into CALIBRATION MODE enable the disengagement of the coupling means, together with the revolvers assembly coupled with them, from the drive mechanism. The changeover means comprise a slider 9 which is accessible from outside, and, preferably, a flat end 39*a* of the calibration wrench 39.

The resetting means, in the preferred embodiment here described, comprise the shape end 18*d* of the counter clutch 18 for cooperation with the respectively shaped the second end of the calibration wrench 39, which is provided with the cross tongue 39*b*.

In order to carry out the pipette calibration, the adjustment knob 5 should be placed in its lower extreme position i.e. the same way like in PIPETTING MODE in LOCKED POSITION of the plunger working stroke adjustment mechanism with the lock mechanism activated. Then, the plug 6 should be taken out from the opening 4*b* of the ejector push button 4 with the assistance of the calibration wrench 39 which flat end 39*a* should be entered in a caving 4*a* of the push button 4 of the ejector 2 in order to lever the plug 6, see FIGS. 2 and 5.

Figure 10:
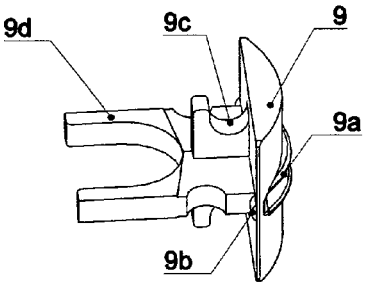

In the next step, the flat end 39*a* of the calibration wrench 39 provided with the pipette should be introduced into a longitudinal socket 9*a* of the slider 9, which is shown in enlargement in FIG. 10, and should be moved from its lower extreme position to its upper extreme position until catch pawls 9*b* skip from lower grooves 1*a* of the handle 1 into upper grooves 1*b* of the handle 1. The lower grooves 1*a* and the upper grooves 1*b* are shown in enlargement in FIG. 13. In such a way, by means of the changeover means the pipette is changed over into CALIBRATION MODE. The upward displacement of the slider 9 coupled with the counter clutch 18 by means of the slider yoke 9*d*, which yoke 9*d* is placed in the circumferential groove 18*b* of the counter clutch 18, causes the axial displacement of the counter clutch 18 along the counter axis 24. The axial displacement of the counter clutch 18 causes disengagement of the counter clutch 18 from the shape clutch 17*a*, see FIG. 5.

Further, the calibration wrench 39 should be inserted with its end with the cross tongue 39*b* into the opening 4*b* of the push button 4 of the ejector 2 so that its end with the cross tongue 39*b* hits the respectively formed shape end 18*d* of the counter clutch 18, which is shown in enlargement in FIG. 8. After engaging the cross tongue 39*b* with the counter clutch 18, the change of the indication in the pipette counter is possible due to turning with the calibration wrench 39 and without the change of the position of the upper stop 13 which is mounted in the plunger working stroke adjustment mechanism. Thereby the change of the indication in the pipette counter is possible without the change of the setting of the volume value of the liquid drawn-up by the pipette. In such a way, by the resetting means the respective change of the liquid volume value indication is being performed on the counter.

For performing CALIBRATION MODE, the disengagement of the mechanical counter revolvers assembly of the shape clutch 17*a* of the clutch gear-wheel 17 from the toothed gear of the drive mechanism has to be carried out, wherein the toothed gear remains in continuous engagement with the plunger working stroke adjustment mechanism.

In order to prevent the pipette from the incidental changeover from CALIBRATION MODE to PIPETTING MODE by an unintentional and incidental downwards pressing the counter clutch 18 due to the non-competent or careless introducing of the calibration wrench 39 into the shape end 18*d* of the counter clutch 18, the counter axis 24 has the respective length. This counter axis length is chosen such that the end of the calibration wrench 39, which has the cross tongue 39*b* formed, in the course of turning in CALIBRATION MODE with the counter clutch 18 for the change of the counter indication is continuously abutted against the face 24*a* of the counter axis 24 and simultaneously does not exert the pressure on the face 18*h* of the shape end 18*d* of the counter clutch 18, as shown in FIG. 4 and FIG. 8. In such a way, it is not possible for the user to move axially the counter clutch 18 downwards by accident that is incidental changeover of the pipette into PIPETTING MODE by unintentional exertion of the pressure on the counter clutch 18 has been eliminated.

In CALIBRATION MODE, during the upward displacement of the slider 9 coupled by means of the circumferential groove 18*b* with the counter clutch 18, the displacement of the counter clutch 18 takes place. This is such a displacement that the elastic click 30*a* of the counter cover 30 starts to cooperate with the lower part of the shape portion 18*c* of the counter clutch 18. The shape portion 18*c* forms technical means for two-stage differentiation of the torque value which is indispensable to induce the change of the angle position of the coupling means around the counter axis 24. The shape portion 18*c* is in its lower part provided with the larger protrusions 18*g* for cooperation with the elastic click 30*a* of the counter cover 30, respectively, in the pipette CALIBRATION MODE.

In this system, the resistance moment caused by deflection of the elastic click 30*a* during the rotation of the counter clutch 18 by means of the calibration wrench 39 is larger then the torque on the counter clutch 18 in ADJUSTMENT MODE. However, in CALIBRATION MODE, the torque which is exerted by the user during the rotation with the calibration wrench 39 is still significantly less than the torque which is exerted on the adjustment knob 5 in ADJUSTMENT MODE because of the lack of any gear ratio. However, in order to increase the calibration accuracy, the discrete leap of the mechanical counter indication has to be well recognized by the user. Therefore, in CALIBRATION MODE, the elastic click 30*a* cooperates with the larger protrusions 18*g* formed on the lower part of the shape portion 18*c* of the counter clutch 18, which increases the resistance moment caused by the deflection of the elastic click 30*a* during the rotation of the counter clutch 18 by means of the calibration wrench 39. Thus, the torque value, which has to be overcome and has to be exerted by the user during turning with the calibration wrench 39, increases.

The discretization of the change of the counter indication is, thus, in CALIBRATION MODE better perceptible by the user od the mechanical pipette according to the present invention. The larger value of the torque necessary to change of the angle position of the counter clutch 18 in CALIBRATION MODE enables to control the change of the angle position of the counter clutch 18 around the counter axis 24 and makes the correct adjustment on the counter of the volume value indication of the drawn-up liquid easier.

After completion of the calibration, that is when the counter indication is harmonised with the actual drawn-up liquid volume value, the above mentioned activities should be performed in the inverse sequence. The calibration wrench 39 has to be withdrawn from the opening 4*b* in the push button 4 of the ejector 2, then the slider 9 has to be moved—by inserting the flat end 39*a* of the calibration wrench 39 in the longitudinal socket 9*a* of the slider 9—to its lower extreme position until the catch pawl 9*b* skips with the upper grooves 1*b* of the handle 1 into the lower grooves 1*a* of the handle 1, and simultaneously engaging the counter clutch 18 with the clutch gear-wheel 17, and thereby changing over the pipette from CALIBRATION MODE to PIPETTING MODE. Finally, the plug 6 should be placed in the opening 4*b* of the push button 4 of the ejector 2.

Moreover, for preventing the pipette according to the present invention from the incidental miscalibration, the slider 9 of the calibration mechanism is protected against the incidental displacement in all pipette operational modes. For this purpose, in the slider 9, on the ribs with the semicircular notches 9*c* additional technical elastic means were mounted, which constitute the elastic element 36 in the form of O-ring, see FIGS. 5, 10, 12 and 13.

Tip Ejection Mode

For exchange of the tip 8 in the pipette, in the case when the tip 8 is worn or damaged or when there is a need of the change of the working values of liquid volume, and to avoid the contact of the user pipette with the aspirated liquids, the pipette according to the present invention is provided with the improved ejection mechanism of the exchangeable tip 8 from the pipette nozzle 3.

In the pipette according to the present invention, the technical solution is applied, which decreases the value of the force necessary to eject the tip 8 from the nozzle 3. Due to application of the mechanism of the second-class lever, the force necessary to remove the tip 8 has been reduced by the value which results from the distance ratio between the place where the force is applied by the user, which distance has the variable value dependent on the way of the operation with the push button 4 by the user, and the rotation axis of the push button 4 and the distance from the rotation axis of the push button 4 to contact points of the push button 4 with the arms 37*a* of the frame 37 of the intermediate means for transferring the force from the push button 4 to the ejector 2, which distance has the variable value dependent on the rotation angle of the push button 4.

In the presented preferable embodiment of the present invention, as the intermediate means between the push button 4 and the ejector 2 of the ejection mechanism, which serve to transfer the force from the push button 4 onto the ejector 2, the frame 37 cooperating with the sleeve 38 connected with the ejector 2 are applied.

The principle of functioning of the applied ejection mechanism is as following: when the pipette user wants to eject the tip 8 from the pipette nozzle 3 presses the ejector push button 4 in the place where the plug 6 is pushed into the opening 4*b* of the push button 4. In consequence, the angle movement of the push button 4 around the rotation axis of the push button 4 of the ejector 2 is caused. The rotation axis is created by bearing of cylindrical side pins 4*d* of the push button 4 of the ejector 2 in respectively formed cylindrical cavings 1*c* of the handle 1, which are shown in FIGS. 5 and 12 and in enlargement in FIG. 14 as well as in cylindrical cavings 35*b* of the cover 35 of the handle 1, which are shown in FIG. 12. The angle movement of the push button 4 causes the longitudinal movement of the frame 37 of the intermediate means of the ejection mechanism due to sliding of the arms 37*a* of the frame 37 along the rectilinear contact surfaces 4*c* of the push button 4, which are shown in enlargement in FIG. 15.

For elimination of lateral skid of the arms 37*a* of the frame 37 from the rectilinear contact surfaces 4*c* of the push button 4, ends 37*b* of the arms 37*a* of the frame 37 are formed with the canopy shape and, similarly, the cooperating with them, in TIP EJECTION MODE, the rectilinear contact surfaces 4*c* of the push button 4 are formed with the notches of the corresponding canopy profile.

The frame 37 of the intermediate means is longitudinally guided between the guiding ribs 1*d* and 1*e* of the handle 1, which are shown in FIG. 12, and the abutting tongues 15*c* of the bearing sleeve 15, see FIG. 5. Due to such an arrangement, the frame 37 is guided in the handle 1 in reliable way and without any disadvantageous friction. The angle movement of the push button 4 of the ejector 2 causes the longitudinal movement of the frame 37 of the ejector 2, which then is transferred onto the abutting surface 38*a* of the sleeve 38 of the ejector 2. The sleeve 38 is screwed in via a screwed connection with the ejector 2, as shown in FIG. 2. Further, the lower end of the ejector 2 during its downward movement pushes the tip 8 with its ejection edge away from the nozzle 3.

The ejector 2 return to the initial position is assured due to the return spring of the ejection mechanism, which acts onto the sleeve 38 of the ejector 2 in the direction opposite to the direction of the force exerted by the user onto the push button 4 of the ejector 2.

Due to such a constructional solution of the ejection mechanism, it is possible to obtain the large working stroke of the pipette ejector 2 and, simultaneously, the large reduction of the force indispensable to eject the tips 8 in result of the respective proper choice of geometry of the cooperating component elements.

The structure of the ejection mechanism enables to obtain a non-linear characteristic of the longitudinal movement of the frame 37 of the intermediate means versus the rotation angle of the push button 4 of the ejector 2. In the initial phase, the angle movement of the ejector push button 4 results in the small longitudinal movement of the frame 37 and the sleeve 38 thereby causing the substantial decrease of the value of the force which is necessary to eject the tip 8 from the pipette nozzle 3. Then, due to the displacement of the contact point of the ends 37*b* of the arms 37*a* of the frame 37 of the ejector 2 with the rectilinear contact surfaces 4*c* of the push button 4 towards the point of the application of the force by the pipette user, the leverage of the second-class lever decreases at simultaneous increase of the route of the longitudinal movement of the frame 37 of the ejector 2. Thus, in the terminal phase of TIP EJECTION MODE, in the pipette according to the present invention, the accelerated removal of the tip 8 from the nozzle 3 takes place in comparison with the known pipettes.

The ejection mechanism applied in the pipette according to the present invention, the construction of which provides the long working stroke of the ejector 2, enables that the pipette is able to the cooperation with the wide portfolio of the tips 8 of different geometries for the given volume value of the drawn-up liquid.

Moreover, from the perspective of the necessity to provide the high accuracy and repeatability of the volume values aspirated by the pipette in PIPETTING MODE, the temperature of the pipette interior should be constant. However, during long operation with the pipette, the pipette, which is held in the user hand, is heated and together with it also the air contained inside the pipette is heated. This has disadvantageous impact onto the change of the pipette accuracy deviation during the pipette operational use and forces the correction of the pipette accuracy deviation in CALIBRATION MODE. In the present pipette, due to the improved structure of the ejection mechanism performing the angle movement of the push button 4 of the ejector 2, the forced air circulation takes place inside the pipette in TIP EJECTION MODE. This induces the exchange of the heated air into the cool one and significantly increases the metrological pipette accuracy.

The ejection mechanism disclosed in the present description may be applied in the mechanical pipettes of different structures than hereby disclosed, and especially in the pipettes provided with different plunger working stroke adjustment mechanisms, different engaging mechanisms, different counter drive mechanism and with different calibration mechanisms, as well as in the electronic pipettes.

On the basis of the above example embodiments of the invention, it is possible to provide its different changes, modifications and improvements, while such changes, modifications and improvements are obvious in the light of the idea of the invention and the attached hereto patent claims.

| List of structure elements | |
|---|---|
| 1. | Handle |
| 1a. | Lower groove |
| 1b. | Upper groove |
| 1c. | Cylindrical caving |
| 1d. | Guiding rib |
| 1e. | Guiding rib |
| 2. | Ejector |
| 3. | Pipette nozzle |
| 4. | Push button (of the ejector 2) |
| 4a. | Caving |
| 4b. | Opening |
| 4c. | Contact surface |
| 4d. | Side pin |
| 5. | Adjustment knob |
| 5a. | Groove |
| 5b. | Ratchet |
| 5c. | Notch |
| 6. | Plug |
| 7. | Pipetting button |
| 8. | Tip |

-continued

| List of structure elements | |
|---|---|
| 9. | Slider |
| 9a. | Socket |
| 9b. | Catch pawl |
| 9c. | Notch |
| 9d. | Yoke |
| 10. | Counter cover |
| 11. | Pipetting rod |
| 11a. | Spherical lower end |
| 11b. | Tongue |
| 11c. | Upper surface |
| 12. | Adjustment screw |
| 12a. | Circumferential groove |
| 12b. | Groove |
| 12c. | Groove |
| 12d. | Rib |
| 12e. | Cavings |
| 13. | Upper stop |
| 13a. | Rib |
| 13b. | Lower surface |
| 14. | Adjustment sleeve |
| 14a. | Toothed-wheel rim |
| 14b. | Notch |
| 14c. | Catches |
| 14d. | Cone |
| 15. | Bearing sleeve |
| 15a. | Guiding groove |
| 15b. | Rectangular opening |
| 15c. | Abutting tongue |
| 16. | Double gear |
| 16a. | Pinion |
| 16b. | Gear |
| 17. | Clutch gear-wheel |
| 17a. | Shape clutch |
| 18. | Counter clutch |
| 18a. | Lower portion |
| 18b. | Groove |
| 18c. | Shape portion |
| 18d. | Shape end |
| 18e. | Protrusion |
| 18f. | Smaller protrusion |
| 18g. | Larger protrusion |
| 18h. | Face (of the shape end 18d) |
| 19. | Counter spring |
| 20. | Washer |
| 21. | Revolvers sleeve |
| 21a. | Protrusion |
| 21b. | Notch |
| 22. | Revolver |
| 23. | Pinion |
| 24. | Counter axis |
| 24a. | Face (of the counter axis 24) |
| 25. | Revolver |
| 26. | Pinion |
| 27. | Revolver |
| 28. | Pinion |
| 29. | Revolver |
| 30. | Counter cover |
| 30a. | Elastic click |
| 31. | Spring (of the elastic click 30a) |
| 32. | Lock |
| 33. | Plunger |
| 34. | Brake sleeve |
| 34a. | Yoke |
| 34b. | Cone |
| 34c. | Guiding arm |
| 34d. | Groove |
| 35. | Cover (of the handle 1) |
| 35a. | Rib |
| 35b. | Cylindrical caving |
| 36. | Elastic element |
| 37. | Frame (of the ejector 2) |
| 37a. | Arm |
| 37b. | End |
| 38. | Sleeve (of the ejector 2) |
| 38a. | Abutting surface |

-continued

| List of structure elements | |
|---|---|
| 39. | Calibration wrench |
| 39a. | Flat end |
| 39b. | Cross tongue |

The invention claimed is:

1. A mechanical pipette with an adjustable volume value of aspirated liquid, comprising a handle and a nozzle, and coupled with said handle and said nozzle:

a pipetting button connected with a plunger disposed in said pipette, a plunger working stroke adjustment mechanism screw, a mechanical counter responsive through a mechanical counter drive mechanism to rotation of the adjustment screw configured to indicate a volume value of liquid drawn-up by the pipette depending on an adjusted plunger working stroke, and a calibration mechanism configured to correct pipette deviation between the actual volume value of dispensed liquid and the liquid volume value indicated on said mechanical counter, said calibration mechanism comprising a releasable coupling which disengages said mechanical counter from said drive mechanism, and a manually operated reset element coupled with said mechanical counter configured to reset a liquid volume value indication on said mechanical counter while said mechanical counter is disengaged from said drive mechanism.

2. The pipette according to claim 1, wherein said releasable coupling is slidably and rotatably arranged on a counter axis.

3. The pipette according to claim 1, wherein said releasable coupling comprises a clutch gear-wheel and a counter clutch.

4. The pipette according to claim 1, wherein said releasable coupling comprises a two-stage torque value differentiator configured to induce a change of an angle position of said releasable coupling around a counter axis.

5. The pipette according to claim 4, wherein said torque value differentiator comprises a shape portion comprising an upper part having protrusions and a lower part having protrusions, the protrusions of the lower part being larger than the protrusions of the upper part.

6. The pipette according to claim 1, wherein said releasable coupling is engaged with said mechanical counter via a revolver sleeve, the revolver sleeve comprising longitudinal notches configured to receive longitudinal protrusions of said releasable coupling and the revolver sleeve further comprising a protrusion configured to engage a first revolver of said mechanical counter.

7. The pipette according to claim 1, further comprising a slider which is accessible from outside of the pipette and is engaged with said releasable coupling for selective disengagement and engagement of said releasable coupling.

8. The pipette according to claim 1, wherein said reset element comprises a shape end of a counter clutch for cooperation with a shaped end of a calibration wrench having a cross tongue.

9. The pipette according to claim 1, wherein said mechanical counter comprises an elastic element for continuous mutual pressing of mechanical counter structure elements along a counter axis.

10. The pipette according to claim 9, wherein said elastic element of said mechanical counter comprises a counter spring disposed under a clutch gear-wheel.

11. The pipette according to claim 1, wherein said drive mechanism comprises an adjustment sleeve with a toothed-wheel rim, a toothed gear with a double gear, and a clutch gear-wheel mounted rotatably and slidably on a counter axis, wherein said clutch gear-wheel includes a shape clutch that cooperates with a releasable counter clutch.

12. The pipette according to claim 1, further comprising a lock mechanism comprising a ratchet mechanism configured to prevent adjustment of an adjustment knob of the pipette.

13. The pipette according to claim 12, wherein said ratchet mechanism comprises ratchets which are formed on said adjustment knob.

* * * * *